United States Patent [19]

Penas

[11] Patent Number: 4,789,248

[45] Date of Patent: Dec. 6, 1988

[54] POCKETED MAIL BAG

[76] Inventor: Paul J. Penas, 603 S. Kansas St., Hastings, Nebr. 68901

[21] Appl. No.: 174,392

[22] Filed: Mar. 28, 1988

[51] Int. Cl.[4] ..... B65D 30/22

[52] U.S. Cl. ..... 383/38; 383/42; 383/89

[58] Field of Search ..... 383/42, 38, 89, 92

[56] References Cited

U.S. PATENT DOCUMENTS

| | | | |
|---|---|---|---|
| 2,684,097 | 7/1954 | Treul | 383/38 |
| 2,707,010 | 4/1955 | Armistead | 383/38 |
| 4,580,667 | 4/1986 | Herwood | 383/117 |

FOREIGN PATENT DOCUMENTS

| | | | |
|---|---|---|---|
| 071220 | 7/1958 | Denmark | 383/42 |

*Primary Examiner*—Willis Little

[57] ABSTRACT

A pocketed mail bag having a back panel elongated from left to right and having top and bottom edges, a forward panel disposed across a lower portion of the back panel and secured thereto in a manner providing a plurality of pockets between the panels, a strap extending across the backside of the back panel and having a buckle-insertable portion extending outwardly at one of the sides of the back panel. The strap has a buckle-carring portion extending from an opposite side of the back panel. The strap extends through the buckle and has a terminal portion extending back across the forward side of the front panel. A fastening device extending through the terminal portion of the strap and through the forward panel and through the strap portion behind the back panel for providing a strong fastening which impinges the strap portions firmly against the respective panels for providing a strong fastening. The forward and back panels also have inwardly-turned edges through which the fastening device extends.

4 Claims, 1 Drawing Sheet

POCKETED MAIL BAG

BACKGROUND OF THE INVENTION

In the prior art, by far the majority of postmen have traditionally bound bundles of mail with individual straps prior to taking them for delivery in rural areas.

However, there has been but slight use made of the pocketed mail bags, each of which has a back panel, a forward panel, and pockets between the panels for receiving mail. Each further had a belt or strap extending across the backside of the back panel and fixed thereto so that when the pockets are full, the strap can be buckled, holding multiple small bundles into a single larger bundle, protected inside the special pocketed mail bags. Such pocketed mail bags are only for rural carriers because they can open them at the inside of a truck.

A reason for the continued use of individually strapped bundles throughout the rural United States, instead of the pocketed mail bags may be because the pocketed mail bags tear easily. Soon the buckle end is torn from the canvas panels.

An object of this invention is to provide the construction of a pocketed mail bag which is so strong at the attachment between the buckle strap section and the canvas panels that a greater popularity of pocketed mail bags could result therefrom.

Pocketed mail bags generally have had three compartments, whereby a single strap buckling holds three bundles, eliminating the need for two bucklings, therefore, being more efficient by saving time and simplifying handling. Pocketed mail bags are also neater and give the pocketed mail good protection.

In addition, mail can be put in a pocket and quickly withdrawn.

But, regardless of the great advantages that pocketed mail bags could have, their inherent weakness has been a factor in preventing their general adoption.

It is, therefore, an object hereof to make them strong enough to become generally used for the benefit of the rural postal system. When individual straps are used, mail that is inherently slick tends to fall out of a strap spilling on the floor or ground. But it does not tend to fall out of a pocket.

DESCRIPTION OF THE PREFERRED EMBODIMENT

Figure 1:
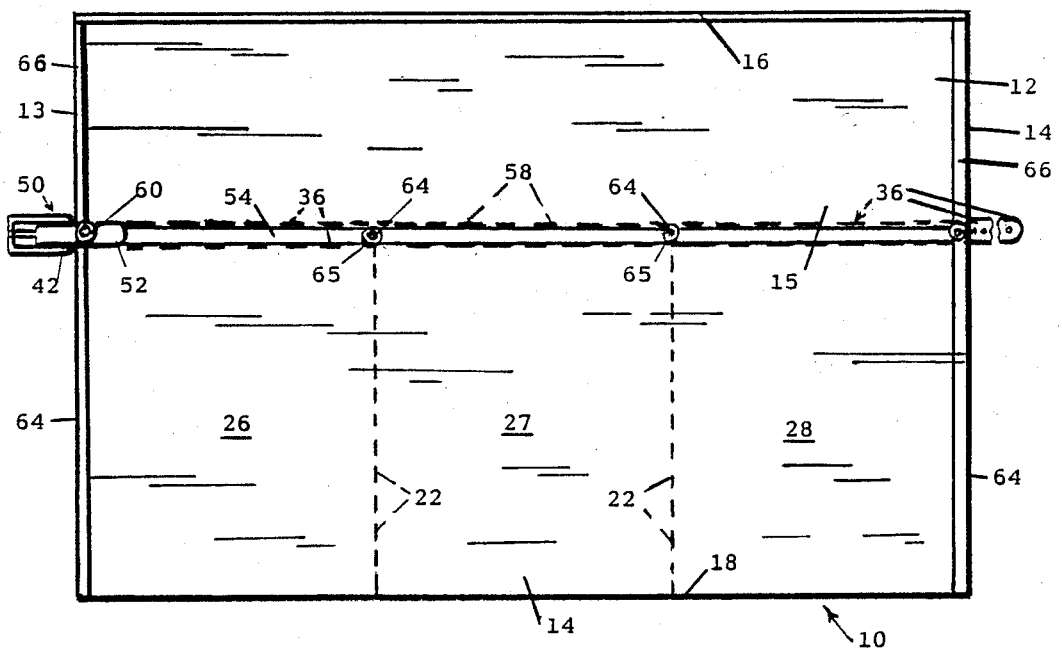
FIG. 1 is a frontal elevation of a pocketed mail bag.
Figure 2:
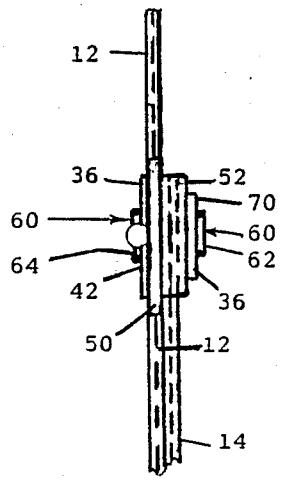
FIG. 2 is a Sectional view of the right-hand view of the bag of FIG. 1 as seen in FIG. 1.

The pocketed mail bag 10 hereof is shown in FIG. 1 and has a back panel 12 elongated from a left end 13 to a right end 14.

The back panel 12 has top and bottom edges 16 and 18.

A forward or front panel 14 is disposed across a lower portion of the forward side 15 of the back panel 12 and is secured thereto by stitching along two upwardly extending stitch lines 22 in a manner providing three equally sized upwardly opening pockets 26, 27, and 28 between the panels 12 and 14.

A strap 36 extends across the backside of the back panel 12 parallel to the elongation thereof and to the top and bottom sides thereof.

The strap 36 has a buckle-insertable portion 38 extending outwardly at the right end 14 of the back panel.

The strap 36 has a buckle carrying portion 42 extending from the opposite or left side of the back panel, the strap portion 42 extending through a buckle 50 and having a terminal portion 52 extending back across the forward side 54 of the front panel 14.

A suitable fastening device or rivet 60 having forward and rearward heads 62 and 64 extends through the terminal portion 52 of the strap and also through the forward panel 14 and through a strap portion 58 behind the back panel 12 for providing a strong fastening which impinges the strap portions 52 and makes a strong fastening. The forward and back panels 12 and 14 also have inwardly-turned hemmed edges 64 and 66, respectively, at the top and right and left sides of each.

The rivet 60 makes a strong fastening by extending also through the hemmed edge portions 64 and 66 of the back and front panels respectively.

The rivet 60 makes an extra strong fastening because the strap 36 is wider than the rivet 60 and the pressure from the strap portions impinging against the respective panels holds firmly the panels when the bag is thrown around by its buckle.

Other rivets 64 impinge the hemmed edges of the rearward and forward panels and the strap 36 between their ends at the left edge of the bag 10 and at each of two places at the upper ends of stitch lines 22. But also round leather pieces $\frac{3}{4}''$ in diameter are disposed one each under the forward side of each rivet 64 on the forward side of the front panel 14 to spread the impinging force of the rivets which are not as wide; the leather pieces being shown at 65.

The leather of the strap 36 takes the place of the leather washers at the rearward side of each rivet.

Metal washers 70 of larger area than the rivet head are placed one under each rivet head 62 or 64 at the forward and back sides of the bag at the rivets 60 which are at the ends of the bag because the strap is used to throw the bag forcibly at times.

I claim:

1. A pocketed mail bag having a back panel elongated from left to right and having top and bottom edges, a forward panel disposed across a lower portion of said back panel and secured thereto in a manner providing a plurality of pockets between said panels, a strap extending across the backside of said back panel and having a buckle-insertable portion extending outwardly at one of said sides of said back panel, said strap having a buckle-carrying portion extending from an opposite side of said back panel, said strap extending through said buckle and having a terminal portion extending back across the forward side of said front panel, a fastening device extending through said terminal portion of said strap and through said forward panel and through said strap portion behind said back panel for providing a strong fastening which impinges said strap portions firmly against the respective panels, said forward and back panels also having inwardly-turned edges through which said fastening device extends, said forward and rearward panels being secured together along upwardly extending lines providing said pockets.

2. The pocketed mail bag of claim 1 wherein said fastening device comprises a rivet.

3. The pocketed mail bag of claim 1 wherein said strap is attached to an opposite side of said bag from said buckle by means of a second fastening device, said second fastening device comprising a rivet, a leather washer disposed between the forward end of said rivet and said forward panel.

4. The pocketed mail bag of claim 1 wherein said fastening device comprises a rivet, there being an upwardly extending line of joinder between adjacent ones of said pockets, central rivets extending through said forward panel and said rearward panel at the upper edges of said pockets; each central rivet being disposed on a different one of said line of joinder and at the upper ends of such said lines.

* * * * *